US005709385A

United States Patent [19]

Fitzpatrick et al.

[11] Patent Number: 5,709,385

[45] Date of Patent: Jan. 20, 1998

[54] SPORTS BOARD GAME

[75] Inventors: Brian F. Fitzpatrick; Chase L. Fitzpatrick, both of Dove Canyon, Calif.

[73] Assignee: Finger Sports, Inc., Dove Canyon, Calif.

[21] Appl. No.: 534,261

[22] Filed: Sep. 26, 1995

[51] Int. Cl.[6] ..... A63F 7/06; A63F 7/20

[52] U.S. Cl. ..... 273/317.3; 273/317.6; 273/108.1; 273/108.56; 273/284; 273/129 R; 273/126 R; 273/277

[58] Field of Search ..... 273/317.1, 317.2, 273/317.3, 317.4, 317.5, 317.6, 317.7, 317.8, 317.9, 108.21, 108.3, 108.31, 108.32, 108.33, 108.4, 108.41, 108.5–108.56, 108.1, 244.1, 284, 280, 291, 119 R, 129 R, 129 S, 129 T, 277, 126 R, 259

[56] References Cited

U.S. PATENT DOCUMENTS

| | | | |
|---|---|---|---|
| 968,249 | 8/1910 | Meeker | 273/108.31 |
| 1,712,781 | 5/1929 | Williams | 273/317.5 |
| 2,069,514 | 2/1937 | Wylie | 273/317.5 |
| 2,434,195 | 1/1948 | Cantor . | |
| 2,760,776 | 8/1956 | Tullio | 273/317.5 |
| 3,381,961 | 5/1968 | Wright . | |
| 3,428,317 | 2/1969 | Pulcifer . | |
| 3,897,063 | 7/1975 | Lehwalder | 273/284 |
| 4,017,074 | 4/1977 | Roberts . | |
| 4,043,559 | 8/1977 | Eigen | 273/284 |
| 4,123,058 | 10/1978 | Furyk | 273/280 |
| 4,548,409 | 10/1985 | Cacho . | |
| 4,705,276 | 11/1987 | Kastle | 273/280 |
| 4,802,880 | 2/1989 | Shaw | 273/317.5 |
| 4,948,135 | 8/1990 | Follety, Jr. . | |
| 5,110,127 | 5/1992 | Potter . | |
| 5,338,041 | 8/1994 | Jones | 273/284 |

*Primary Examiner*—Sebastiano Passaniti
*Attorney, Agent, or Firm*—Stetina Brunda Garred & Brucker

[57] ABSTRACT

A sports board game played on a substantially flat surface includes a rotatable platform and a plurality of interchangeable game boards, the game boards having a plurality of regions colorfully identified thereon. The board game also includes game pieces, and may include goals around the perimeter of the game board and/or targets fixed above the game board surface. Use of the board game includes sliding movements and/or airborne movements of game pieces along and/or above the game board, in a controlled and precise manner. To accomplish the airborne movement, portable slotted ramps are provided to enable players to accurately aim the path of the game piece, and guide the game piece towards the target. A "Finger-Flick™" movement involves a player placing one finger on the game board, and using a second finger to contact the game piece for movement along and/or above the game board. The sports board game provides multiple subject games within one yielding good entertainment value, provides rotatability between multiple players without disturbing the game pieces, and provides for precise and controlled movement of game pieces thereby preventing their loss and additionally minimizing disagreements between players.

13 Claims, 4 Drawing Sheets

Fig. 1
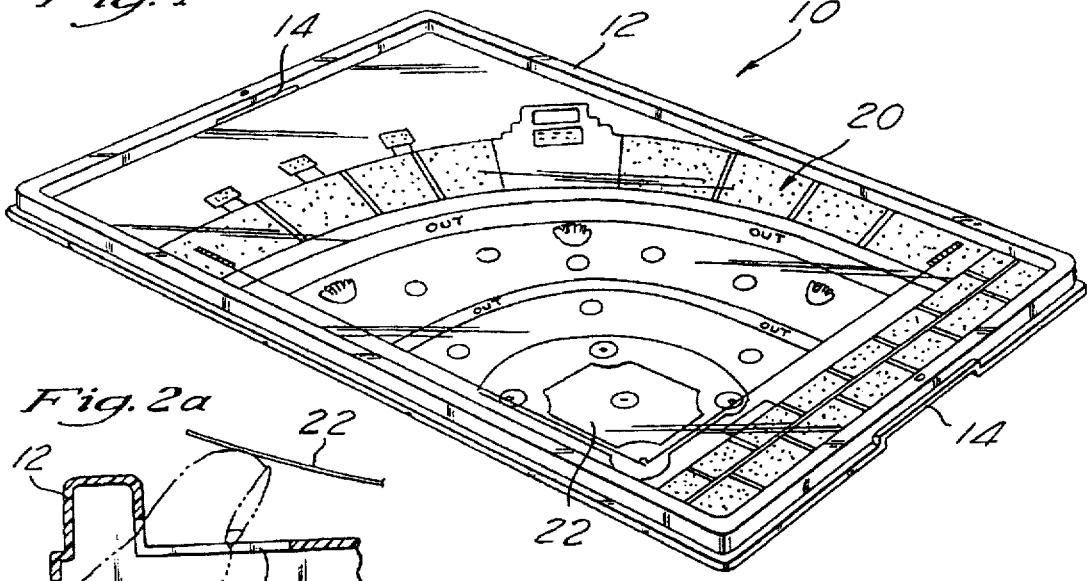
Fig. 2a
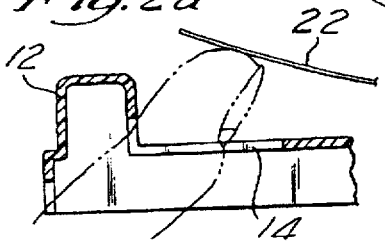
Fig. 2
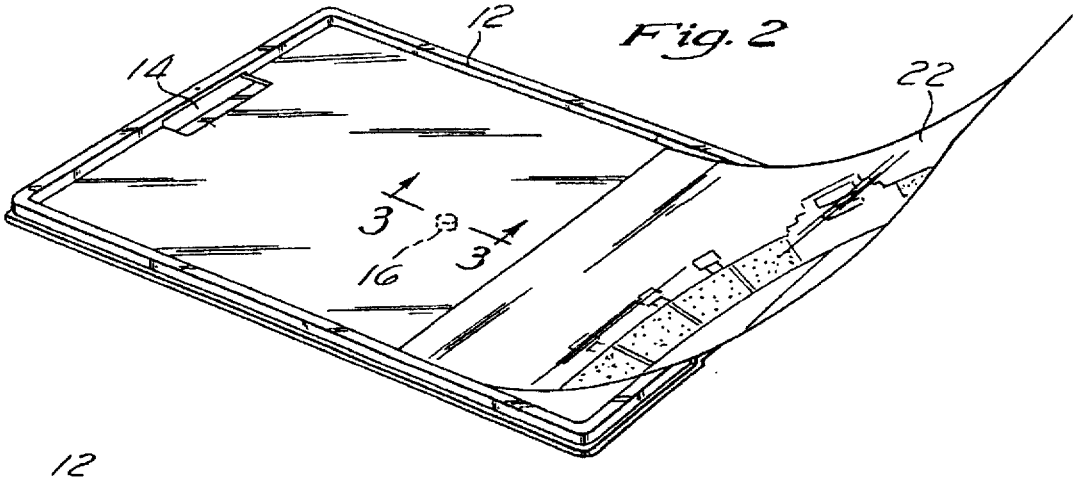
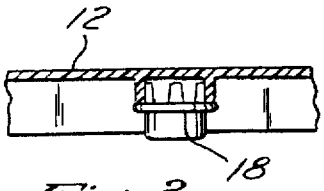
Fig. 3
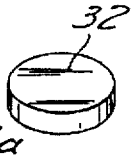
Fig.4a
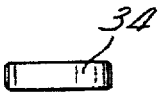
Fig. 4b
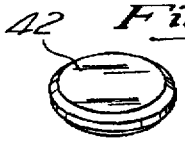
Fig. 5a
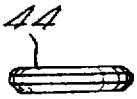
Fig. 5b Fig. 6
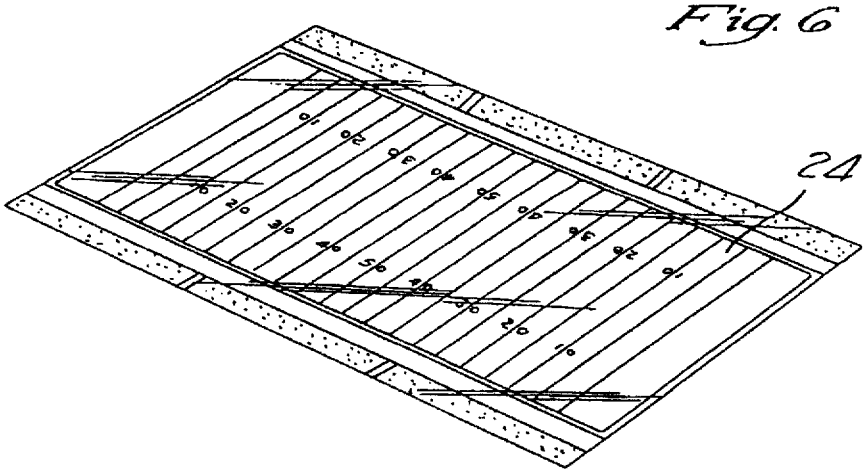
Fig. 7
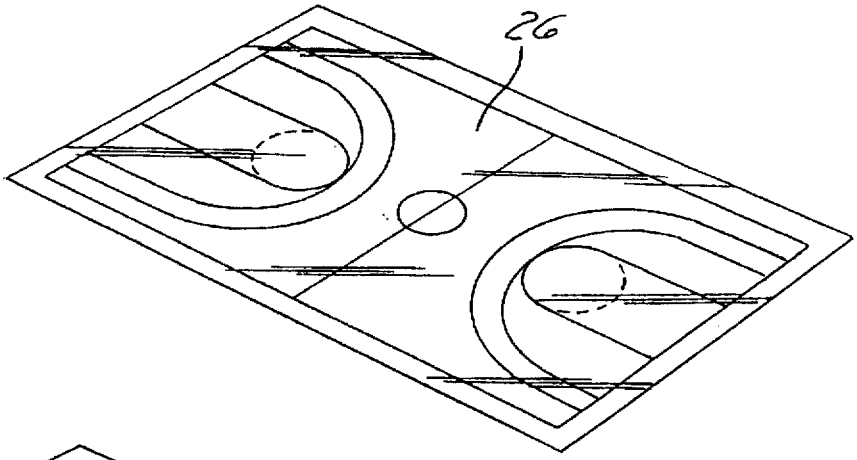
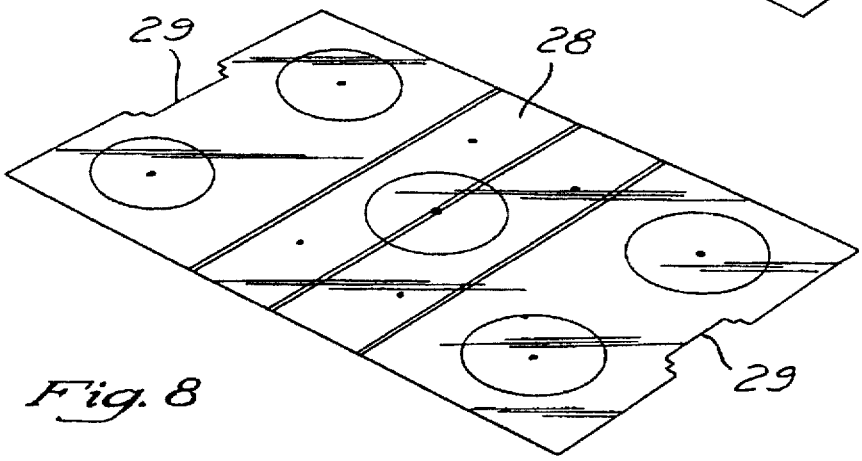
Fig. 8

Fig. 9
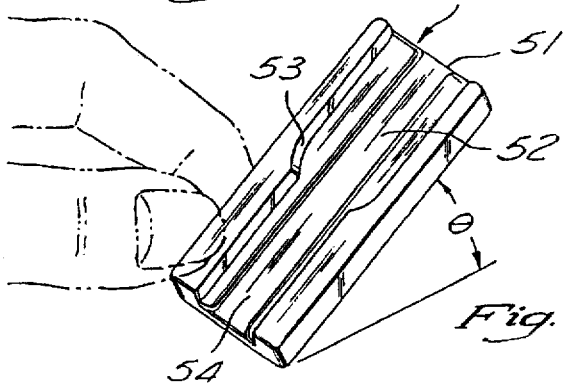
Fig. 10
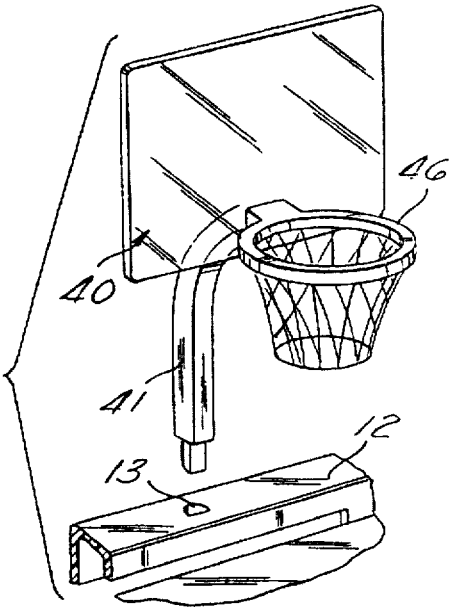
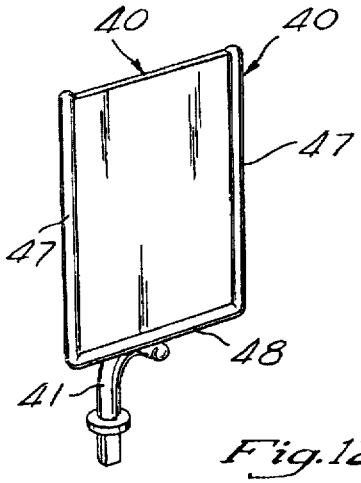
Fig. 11
Fig. 12
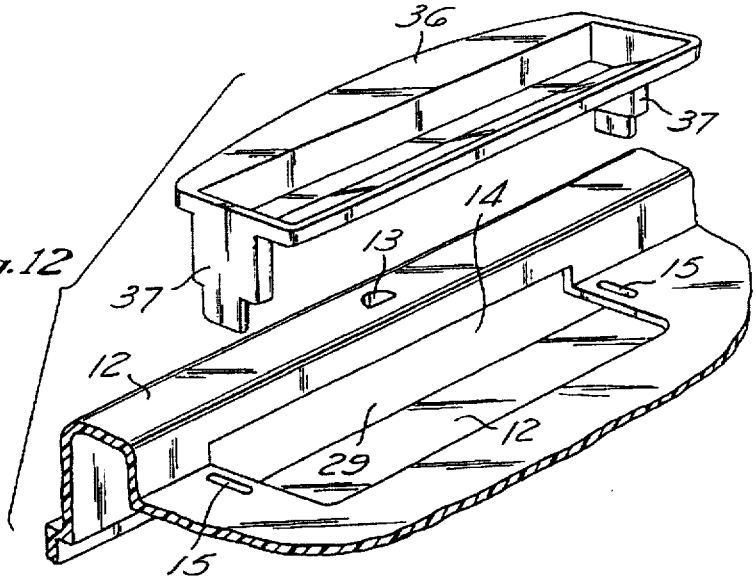
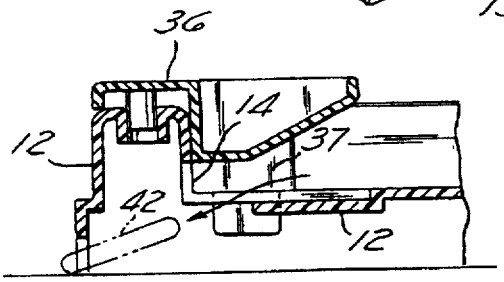
Fig. 13

SPORTS BOARD GAME

FIELD OF THE INVENTION

The present invention relates generally to board games, and more particularly to a multi-subject sports board game including game pieces adapted to be manually propelled above the game board in a manner simulating a particular sport activity.

BACKGROUND OF THE INVENTION

Games of strategy such as chess, checkers, and backgammon played by moving game pieces on a game board are well known. Games pertaining to sports having game boards with regions identified thereon for use with game pieces are also well known, including those which require the skill and coordination or multiple players in movements of the game pieces. The general purpose for such board games lies in their entertainment value especially for children, and also in developing a competitive yet friendly spirit between the players.

Although such prior art sports games have proven generally suitable for their intended purposes, those currently available possess inherent deficiencies which detract form their overall desirability. In such prior art games, multiple players must typically move around the game board to position themselves for aiming and accurate movement of game pieces, between identified regions on the game board. Alternatively, it may be possible to turn the game board on the flat surface on which it is placed, but there is the potential to disturb the location of the game pieces on the board. Additionally, movement of game pieces, especially in the air above the game board, tends to be erratic and uncontrolled, resulting in lost pieces or otherwise causing disputes between players. Also of note, children are easily bored and lack the sustained interest to play only a single game over an extended period of time, but parents find it uneconomical to provide numerous different games, besides each coming with a different set of rules to be learned.

In view of the shortcomings of the prior art, it is desirable to provide a sports board game for multiple players with game pieces which move about the game board, without requiring the players to move around the game board, instead having a game board that can be turned without disturbing the game pieces. Additionally, it is desirable to provide for controlled movement of the game pieces, particularly in flight above the game board. Finally, it is desirable to provide multiple game boards within a single game to sustain the player's interest, while only requiring an expenditure and learning of the rules for one basic game.

Although the prior art has recognized to a limited extent the difficult problem of keeping multiple players entertained with a single basic game for an extended time period, the proposed solutions have to date been ineffective in providing such a sports game that is also affordable. For example, several prior art baseball games include complex bat/ball mechanisms to provide controlled movement about a game playing surface, but such games are necessarily expensive. The solutions now proposed by Applicant have heretofore never been disclosed or suggested.

SUMMARY OF THE INVENTION

The present invention specifically addresses and alleviates the above-mentioned deficiencies associated with the prior art. More particularly, the present invention includes a board game played on a flat surface, preferably having a platform that holds one of several interchangeable game boards, allowing games of multiple sport subjects to be played with a common platform. The game is preferably of the type having a game board with a number of regions identified, and having game pieces placed on and moved about the game board. Additionally, the game board is preferably rotatable on the flat surface upon which it is placed, so that game board may be turned for the convenience of multiple players without the potential of disturbing the game pieces. The rotatability of the game board is preferably accomplished by a pivot pin mounted on the undersurface of the platform.

In a preferred embodiment of the invention, the board game further includes a portable launcher ramp that may be placed on the game board, and used for accurately propelling game pieces about the game board. The launcher ramp preferably is such that the players may vary the angle at which game pieces are propelled above the game board. The launcher ramp preferably includes a slot extending along the ramp upon which the game piece rest and slide through prior to being launched. Additionally, the ramp preferably has a second smaller slot through which the player's finger travels to contact the game piece for launching from the ramp. Use of such a launcher ramp provides for controlled flight of game pieces, reducing the possibility of losing game pieces and tending to minimize disagreements between players.

The method of playing the board game of the present invention includes the steps of first selecting a game board for the subject matter desired, placing the game board on a flat surface, moving game pieces between marked regions of the game board, and rotating the game board between the respective turns of multiple players such that the game pieces are undisturbed. Sliding movements of game pieces include the "Finger-Flick™" technique of placing one finger on the game board adjacent the game piece, and contacting the game piece with a second finger to propell the game piece along the game board. The method of the preferred embodiment may further include placing a slotted ramp on the game board, placing the game piece on the slotted ramp, and propelling the game piece above the game board surface. Preferably, aerial movements of game pieces using the ramps include the steps of the "Finger-Flick™" technique of placing one finger on the game board adjacent the ramp, and contacting the game piece with a second finger to propell the game piece above the game board.

These, as well as other features of the present invention will become more apparent from the following description and drawings. It is understood that changes in the specific structure shown and methods described may be made within the scope of the claims without departing from the spirit of the invention.

BRIEF DESCRIPTION OF THE DRAWINGS

FIG. 1 is a perspective view illustrating the platform and baseball game board in accordance with the present invention;

FIG. 2 is a perspective view showing the interchangeability of the game board;

FIG. 2*a* is a sectional view showing disengagement of the game board from the platform.

FIG. 3 is a sectional view of the rotatable attachment of the board game;

FIGS. 4 and 5 are perspective and side views of game pieces;

FIG. 6 is a perspective view of the football game board;

FIG. 7 is a perspective view of the basketball game board;

FIG. 8 is a perspective view of the hockey game board;

FIG. 9 is a perspective view of the slotted ramp;

FIG. 10 is a perspective view of the basketball target;

FIG. 11 is a perspective view of the football target;

FIG. 12 is a perspective view of the removable goal;

FIG. 13 is a section view of the removable goal;

DETAILED DESCRIPTION OF THE PREFERRED EMBODIMENTS

Figure 14:
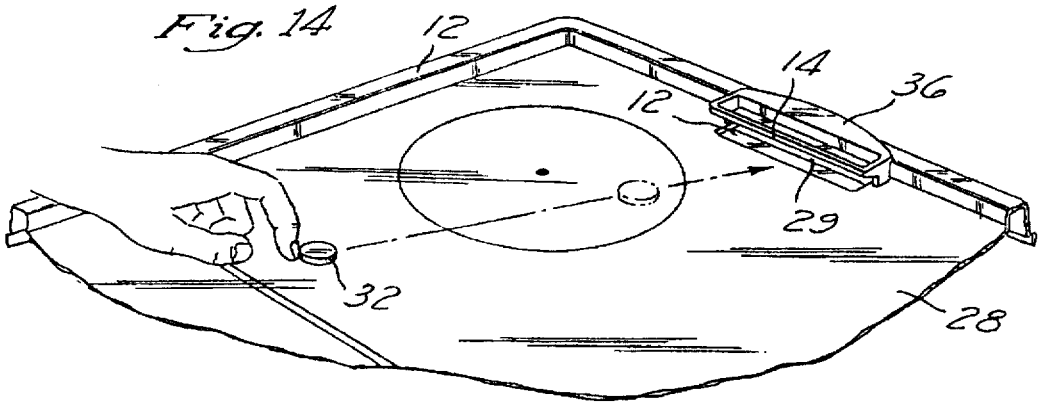
FIG. 14 is a perspective view of the hockey game board using the removable goal.

The detailed discussion set forth below in connection with the appended drawings is intended as a description of the presently preferred embodiments of the invention, and is not intended to represent the only forms in which the present invention may be constructed or utilized. The description sets forth the functions and sequences of steps for constructing and operating the invention in connection with the illustrated embodiments. It is to be understood, however, that the same or equivalent functions and sequences may be accomplished by different embodiments that are also intended to be encompassed within the spirit and scope of the invention.

The sports board game of the present invention is illustrated in FIGS. 1 through 15 which depict presently preferred embodiments of the invention. Referring now to FIGS. 1 through 3, the sports board game 10 is comprised generally of a platform 12 sized to receive a plurality of game boards 20, e.g., a baseball game board 22, a football game board 24 (see FIG. 6), a basketball game board 26 (see FIG. 7), a hockey game board 28 (see FIG. 8), and others too numerous to list, enabling multiple subject sports games to be played from the same platform 12. The platform 12 includes a cutout 14, into which a goal 36 (see FIG. 12) may be inserted if needed for a particular sports game, e.g., hockey or soccer. The interchangeable game boards 20 are adapted to be rapidly removed, or replaced, by a player merely inserting a finger into the cutout 14 in the platform 12 (see FIG. 2*a*) to pop up the game board 22 prior to removing (FIG. 2) and replacing it with another game board 20. Each of the game boards 20 are preferably formed as large sheets of laminated cardboard, having markings or indicia printed thereon indicating various regions on a playing field, court, rink or the like. For example, the baseball game board 22 (as best seen in FIG. 1) depicts the infield including the bases, the outfield with areas corresponding to hits, outs, etc., and the surrounding stands which have outlined areas labeled home run, foul ball, etc.

The platform 12 of the present invention is adapted to be placed on a flat surface (not shown), such as a table top, an indoor floor, and outdoor patio or the like. The platform 12 is preferably fabricated of molded plastic material and formed having a generally rectangular configuration. The platform 12 preferably includes a pivot pin 16 snugly inserted into the platform 12 (see FIG. 3), the pivot pin 16 having a bottom surface 18 against which the platform 12 contacts the flat surface. The sports game 10 is designed to be manually rotated about the pivot pin 16 so that players can move game pieces from any angle about the game board 20, such movements and game pieces to be more fully discussed below. FIGS. 12 and 13 show the configuration of the goal 36 and the platform 12 for the hockey game embodiment. The hockey goal 36 has a pair of spaced apart posts 37, with the lower ends configured to be inserted into a pair of spaced apart slots 15 at opposing ends of the platform 12. As seen in FIG. 13, the "puck" game piece 42 is able to slide through the cutout 29 in the hockey game board 28, and be retrieved below the lower outboard edge of the platform 12.

Now referring to FIG. 14, a method of use of the present invention that includes sliding movements of game piece 32 (FIG. 4*a*) across the game boards 20 may be described. The sports game 10 uses disc-shaped game piece 32, preferably circular plates of molded plastic having only a very small radius 34 at the corner edges, which will tend to remain disposed flat on the game board 20 even after abrupt sliding movements. Importantly, the methods of play for all the sports games 20 roughly follow the same basic principles, in that the game pieces 32 representing a ball, puck or the like are slidably moved around the game board 20 in a precise manner towards various regions thereof, towards other game pieces 32, or towards a goal (e.g., a hockey goal 36). One finger is placed on the game board 20 next to the game pieces 32, while another finger contacts the game pieces 32 and slides it along ("flicks" it) towards various regions on the game board 20 or goals (e.g., the hockey goal 36) around the perimeter of the platform 12. This operation with a player's two fingers is known as a Finger-Flick™. As shown in FIG. 14, Finger-Flick™ hockey would involves Finger-Flick™ movements of the "puck" about the "ice rink" surface game board 28 (FIG. 8), Finger-Flick™ passing between players until getting near the goal 36 and attempting a Finger-Flick™ shot. The complete rules for each of the sports games 20 parallel the actual sporting event, thus they are easy to follow.

Figure 15:
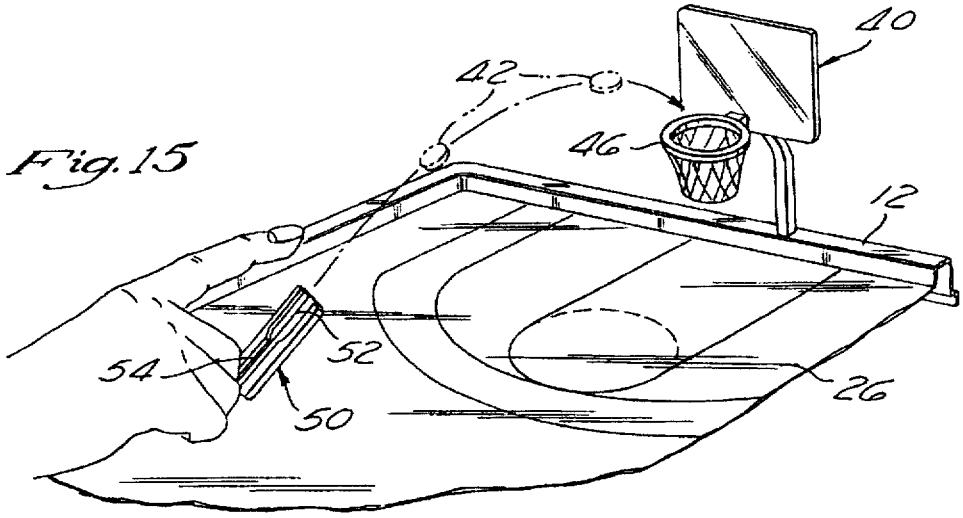
FIG. 15 is a perspective view of the basketball game board using the basketball target and slotted ramp.

A second embodiment best illustrated in FIG. 15 additionally includes possible airborne movement about the game board 20, as well as shooting at targets 40 installed in the platform 12, such targets 40 may extend well above the game board 20 surface (see FIG. 10). The targets 40 typically have a post member 41 that installs into a socket 13 in the platform 12. The target 40 may comprise a basketball backboard, rim 46 and net (as shown in FIG. 15) or could alternatively comprise football goal posts 48 (FIG. 11), or other protruding targets 40. Note that the football goal post 48 includes a solid plane 49 between the uprights 47, to eliminate potential disputes between players as to whether a field goal or extra point is successful. The sports game 10 of the second embodiment preferably uses game pieces 42 including substantial chamfered corners 44, more suited to flying through targets 40 such as the basketball rim 46 (FIG. 15). Importantly, to effectively control the movement of game piece 42 above the plane of the game board 20, a launcher ramp 50 (FIG. 9) is provided. The launcher ramp 50 is preferably a rectangular-shaped plate of molded plastic though wood or other materials would also be acceptable, and includes a game piece slot 52 sized to receive the game piece 32. The game piece slot 52 preferably extends only partially down the launcher ramp 50 and terminates in a radius 53, in which the circular game piece 32 or 42 may rest prior to being launched. The launcher ramp 50 also includes a narrower finger slot 54 extending from the radius 53 of the game piece slot 52 to the bottom end of the ramp 50. It is through this finger slot 54 that the second finger travels just prior to making contact with the game piece 42, sending it up the game piece slot 52 and into the air towards a target 40.

The mode of play for the second embodiment also includes the Finger-Flick™ operation, additionally utilizing the launcher ramp 50 to expand the sports game 10 into the air above the game board 20, while still providing for controlled movement of the game piece 42. A player with one hand grasps the launcher ramp 50 and places it so the front edge 51 is behind a game piece 42 positioned on the game board 20, and raises the front edge 51 to form an angle theta relative the game board 20 (see FIG. 9). Then with a second hand the game piece 42 is placed to rest in the radius 53 of the game piece slot 52, and also with the second hand a finger is passed through the finger slot 54 to contact the game piece 42 and send it towards the target 40 (see FIG. 15). Obviously, the exact order of steps may vary somewhat, e.g., the angle theta of the launcher ramp 50 may be further adjusted, and the direction of the ramp 50 towards the target 40 aligned, after the game piece 42 is placed in the game piece slot 52.

It is understood that the embodiments described herein and shown in the drawings represent only presently preferred embodiments of the invention. Indeed, many board games are contemplated utilizing the same basic principles of the present invention. By way of example only, Finger-Flick™ games have already been developed for the sports of "street" hockey, soccer, tennis, golf, auto racing, volleyball, bowling, shuffle board, darts, and for various educational games such as spell it, math, and more too numerous to list. These and other embodiments obvious to those skilled in the art may be implemented to adapt the present invention for use in a variety of different applications.

What is claimed is:

1. A board game comprising:

a game board;

a game piece positionable upon the game board; and a movable ramp positionable upon the game board for selectively propelling the game piece into airborne movement above the game board, said ramp including a game piece slot which extends partially therewithin and defines a bottom end;

said game piece slot being used to control the launch direction of the game piece and sized to slidably receive the game piece in a manner wherein the game piece rests at the bottom end prior to being propelled from the ramp.

2. The board game of claim 1 wherein the ramp further includes a finger slot which communicates with the bottom end of the game piece slot and is sized to accommodate a player's fingertip, the movement of the player's fingertip through the finger slot facilitating contact with the game piece to propel the game piece from the ramp.

3. The board game of claim 1 further comprising a platform which is positionable upon a substantially flat surface and has the game board releasably attached thereto.

4. The board game of claim 3 comprising multiple game boards interchangeably attachable to said platform.

5. The board game of claim 3 wherein the platform includes a pivot pin for facilitating the rotation thereof relative to the flat surface.

6. The board game of claim 3 further comprising at least one target extending from said platform toward which the game piece may be propelled from the ramp.

7. The board game of claim 3 wherein the platform includes at least one opening for receiving the game piece.

8. The board game of claim 1 wherein the game piece has a generally circular configuration and defines first and second peripheral corner edges.

9. The board game of claim 8 wherein the first and second corner edges have radiused configurations.

10. The board game of claim 8 wherein the first and second corner edges have chamfered configurations.

11. A method of playing a board game, comprising the steps of:

(a) providing a game board;

(b) providing a movable ramp which is positionable upon the game board and includes a game piece slot extending partially therewithin and defining a bottom end;

(c) providing a game piece which is slidably insertable into the game piece slot;

(d) inserting the game piece into the game piece slot such that the game piece rests at the bottom end of the game piece slot;

(e) positioning the ramp upon the game board; and (f) contacting the game piece with a fingertip to propel the game piece from the ramp into airborne movement above the game board.

12. The method of claim 11 wherein step (b) further comprises providing the ramp with a finger slot which communicates with the bottom end of the game piece slot, and step (f) further comprises moving the fingertip through the finger slot to contact the game piece.

13. The method of claim 11 wherein step (e) further comprises orienting the ramp at a desired angle relative to the game board.

* * * * *